US005863214A

United States Patent [19]

Hanak

[11] Patent Number: 5,863,214

[45] Date of Patent: Jan. 26, 1999

[54] ELECTRICAL CONNECTOR WITH PUSH BUTTON LOCKING MECHANISM

[75] Inventor: Rupert Harry Stephen Hanak, London, Great Britain

[73] Assignee: The Whitaker Corporation, Wilmington, Del.

[21] Appl. No.: 800,497

[22] Filed: Feb. 14, 1997

[30] Foreign Application Priority Data

Feb. 21, 1996 [GB] United Kingdom ..... 9603645

[51] Int. Cl.[6] ..... H01R 13/627

[52] U.S. Cl. ..... 439/352; 439/357

[58] Field of Search ..... 439/352, 350, 439/357, 358, 188, 372

[56] References Cited

U.S. PATENT DOCUMENTS 5,275,575 1/1994 Cahaly et al. ..... 439/352
5,314,345 5/1994 Cahaly et al. ..... 439/188
5,586,903 12/1996 Hoffmann ..... 439/352
5,591,041 1/1997 Cecil, Jr. et al. ..... 439/352

FOREIGN PATENT DOCUMENTS 0 693 799-A2 1/1996 European Pat. Off. ..... H01R 13/50

*Primary Examiner*—Hien Vu
*Attorney, Agent, or Firm*—Driscoll A. Nina

[57] ABSTRACT

An electrical connector, for example for automotive airbag applications, comprises a locking device that has locking extensions insertable behind resilient latches of the connector to securely lock them when the connectors are coupled. A pivotly mounted catch prevents precocious insertion of the push button locking member by engaging a shoulder thereof. Upon full mating of the connectors, a camming protrusion of the catch abuts the mating connector causing rotation of the catch which releases the push button. The push button can then be fully depressed into the fully locked position. The catch has a spring member that ensures rotation of the catch into its initial position, when the locking device is pulled up to uncouple the connectors.

14 Claims, 5 Drawing Sheets

2
10
12
14
15
16
18
20
22
24
26
28
29
30
32
34
36
44
46
48
50
65
75

79
59
71
53
52
61
57
65

12
14
73
69
59
71
18
48
44
56
R
57
65
20
6C 46
48
26
32
36
34

79
61
59
71
53
52
81
57
65

12
71
79
59
48
44
56
83

46
48
26
32
18

46
59
79
53
52
48
56
57
65

2
10
12
14
3
71
79
4
8
6
59
48
56

26
52,53
18

ELECTRICAL CONNECTOR WITH PUSH BUTTON LOCKING MECHANISM

BACKGROUND OF THE INVENTION

1. Field of the Invention

This invention relates to an electrical connector, the connector having a latching mechanism with a latch locking member to ensure secure coupling with a mating connector.

2. Description of the Prior Art

A connector for an ignition device, for example an automotive airbag ignition device, is described in U.S. Pat. No. 4,170,939. Ignition of airbag devices in automobiles is an important safety function that requires a safe and reliable electrical connection. It is therefore important to ensure that an electrical connector for an ignition device, is fully coupled with its mating connector, and is securely locked in the coupled position even when subject to mechanical or thermal solicitation. In U.S. Pat. No. 5,314,345, an electrical connector suited for airbag ignition applications, comprises a connector latchable to a mating pin connector by means of resilient cantilever beam latches that engage behind shoulders of the mating pin connector. In order to ensure that the resilient latches do not inadvertently uncouple, a locking clip comprising extensions insertable alongside and against the resilient latches is provided to ensure that the resilient latches remain in the locked position. The locking clip is attached to the housing, but is separately manipulated and assembled into the locking position once the connectors are coupled. Mating of the connector therefore requires a number of manipulations, and in certain circumstances a human operator may miss out one of the assembly steps or effect it in a faulty manner, for example forgetting to insert the locking clip or not inserting it fully.

It is a continuous requirement, for example in the automotive industry, to simplify assembly procedures to reduce assembly time, whilst nevertheless increasing the reliability of assembly. The latter is not only important for reliability of safety features such as airbag ignition devices, but also to reduce the cost of production. It would therefore be desirable to produce a reliable connector latching system with locking feature, that can be easily coupled to a mating connector with a minimum number of operations, and easy detection of faulty latching if this should occur.

SUMMARY OF THE INVENTION

It is therefore an object of this invention to provide a connector, for example for automotive airbag ignition devices, that can be coupled in a simple but secure and reliable manner.

It is an object of this invention to provide a connector that can be securely latched and locked to a complementary connector, the connector ensuring secure and reliable coupling and easy detection of incorrect coupling if this should occur.

Objects of this invention have been achieved by providing an electrical connector comprising latches engageable with complementary latching means of a complementary connector for latching the connectors together in a mated condition, the connector further comprising a latch locking device having extensions engageable behind the latches once the connectors are mated together to lock the latches in the latching position, wherein the connector further comprises a catch having a retention shoulder that engages the locking device to maintain it in the unlocked position, the catch being movable by camming engagement thereof with the complementary connector in the fully mated position, such that the retention shoulder releases the locking device and allows full insertion to lock the connector. The latches could extend in a mating direction of the connectors, wherein the locking extensions are insertable behind the latches in the mating direction of the connectors. The locking extensions could be attached to a push button extending above a top wall of the connector remote from the mating end, in the unlocked position, such that during mating the push button is merely depressed in order to effect the locking. Mating of the connectors in the insertion direction, and subsequent actuation of the locking extensions also in the insertion direction by means of the push button extending beyond a top surface, requires only a single operation by an operator. Faulty coupling is easily detected, because if the connector is not fully inserted, the locking extensions will not be able to bias the latch arms and thus the locking extension will remain in the uninserted position. The push button provides easy visual detection of the unlocked state, as it can be provided flush with the top wall of the connector in the fully locked position, but projecting beyond the top wall in the unlocked position. The catch however ensures that the locking device is only actuated once the connectors are fully coupled, thereby providing a complete, secure, and reliable connection whilst nevertheless enabling rapid single action plugging connection therebetween. Other advantageous will be apparent from the description, drawings and claims.

DETAILED DESCRIPTION OF THE PREFERRED EMBODIMENT

Figures 1, 2:
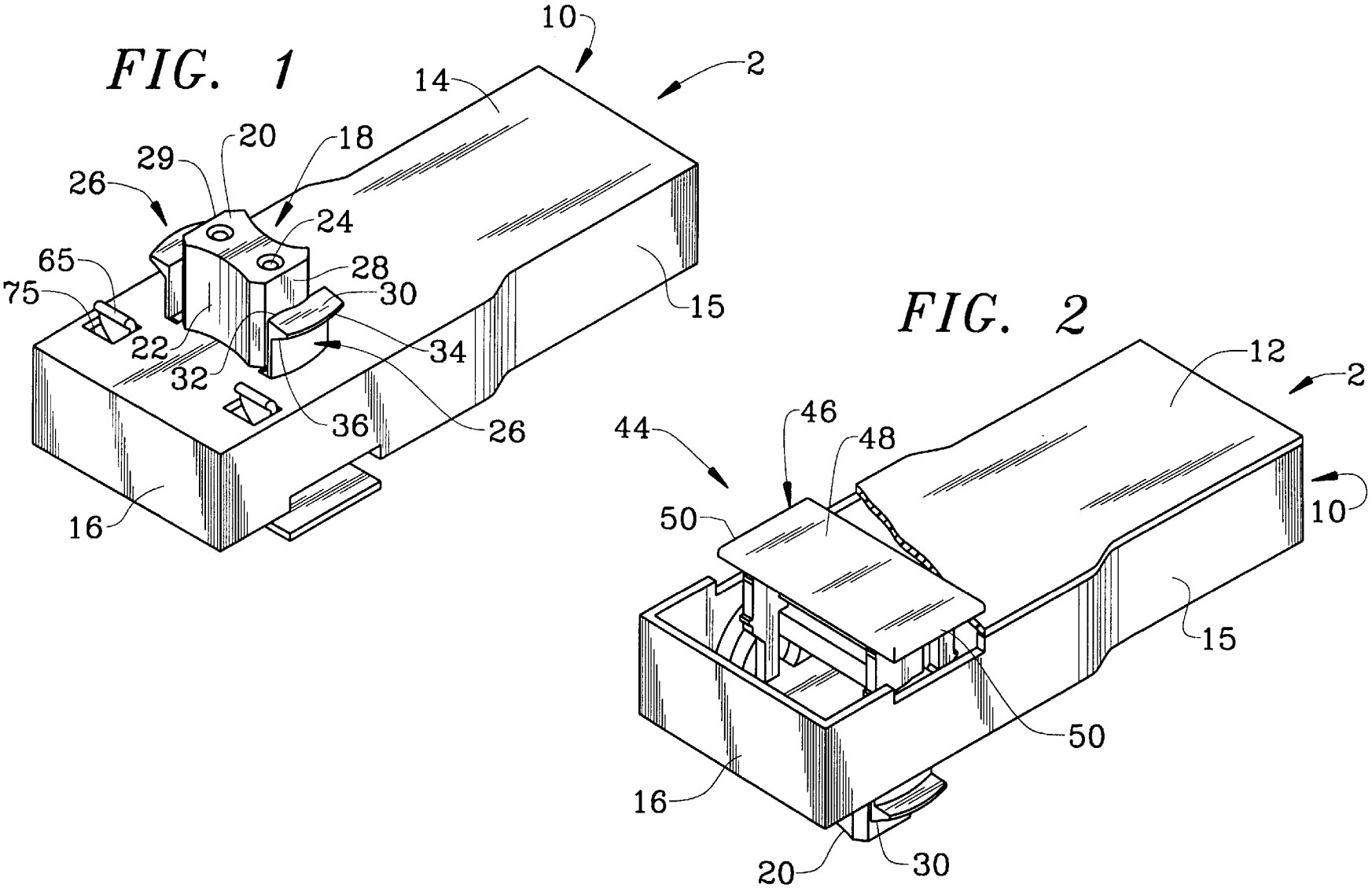
FIG. 1 is an isometric view of a connector according to this invention showing the mating side of the connector.
FIG. 2 is an isometric view of the connector of FIG. 1 but toward the top wall with some of the top wall removed.
Figure 3:
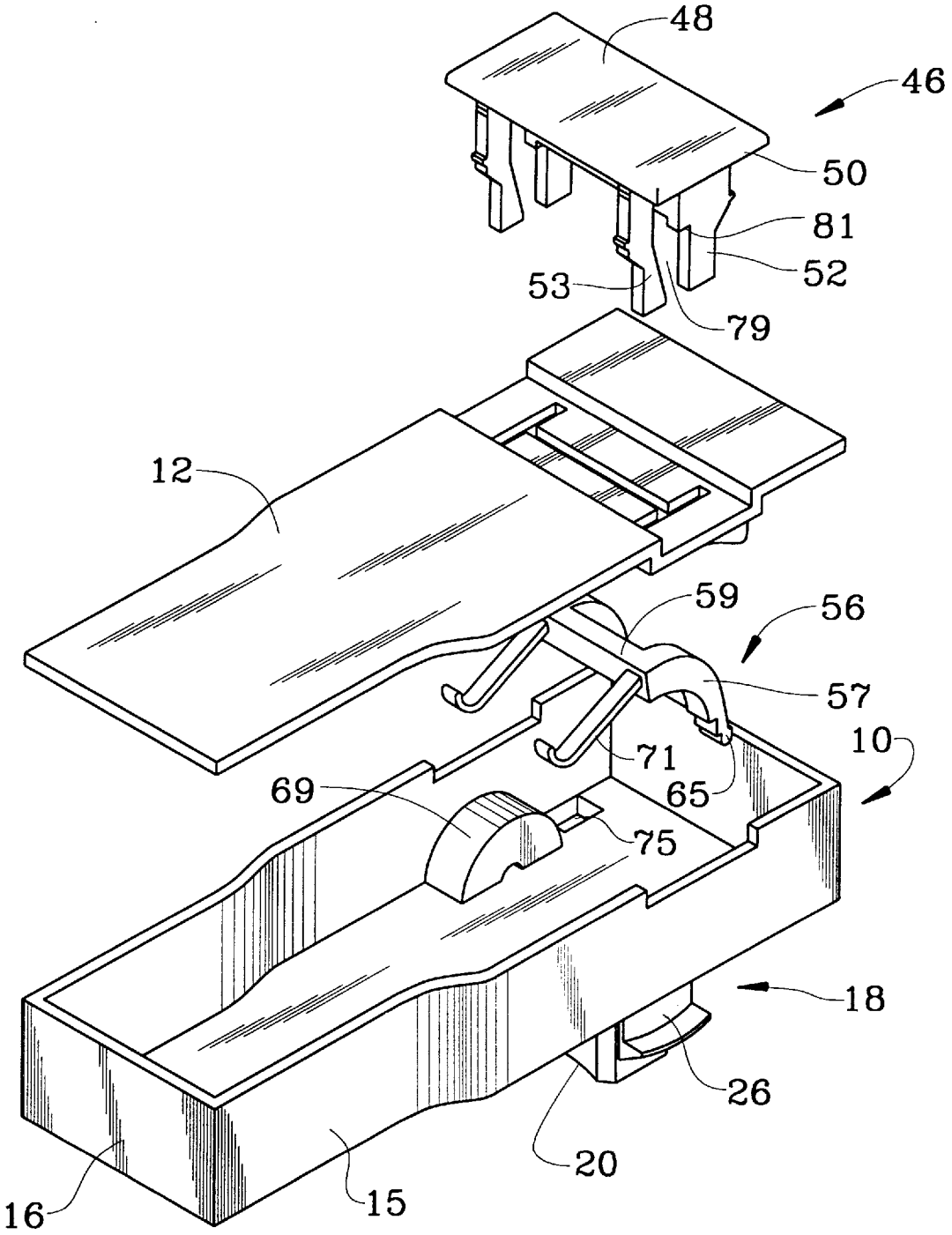
FIG. 3 is an exploded isometric view of the connector according to FIGS. 1 and 2, showing the latch locking device and the locking device catch.

Referring to FIGS. 1–3 and 8, an electrical connector 2 is for mating to a complementary connector 3 which may, for example, be interconnected to an airbag ignition device. The complementary connector 3 comprises an insulative housing 4 surrounding a profiled cavity area 6 within which a pair of pin contacts 8 extend in an axial (mating) direction.

The connector 2 comprises an insulative housing 10 having a top wall 12 and opposed thereto a bottom wall 14, and side and end walls 15,16 respectively extending therebetween. The housing 10 further comprises a contact receiving section 18 extending axially below the bottom wall 14 towards a mating end 20. The contact receiving section 18 extends in a prismatic fashion and has an outer wall 22 profiled to be received in the cavity 6 of the complementary connector. The "dog-bone" shape of the profile 22 is common in the automotive airbag industry, and is shown for example in U.S. Pat. No. 4,170,939. The contact receiving section 18, comprises cavities 24 for receiving receptacle contacts (not shown) for mating with the complimentary connector pin contacts 8.

The connector 2 further comprises resilient latches 26 extending from the bottom wall 14 towards the mating end 20, and positioned proximate opposing sides 28,29 of the contact receiving section 18. The latches 26 are in the shape of cantilever beams attached to the housing substantially at the bottom wall 14 and extending in the direction of the mating end 20 to free ends 30. The latches 26 are separated from the sides 28,29 of the terminal receiving section 18 by a gap 32 (also see FIG. 6*c*). The latch 26 further comprises a locking protrusion 34 that provides a locking shoulder 36 for engagement with complementary latching means along walls of the cavity 6 of the complementary connector.

The connector 2 is mated to the connector 3 by plugging the connector contact receiving section 18 into the complimentary cavity 6, whereby the latch protrusions 34 engage the end walls 42 of the complementary connector cavity 6, and resiliently bias inward until full insertion of the connectors 2 and 3 together, whereby the latching protrusions 34 latch onto the complementary latching means and bias out to their natural state.

Figure 4A:
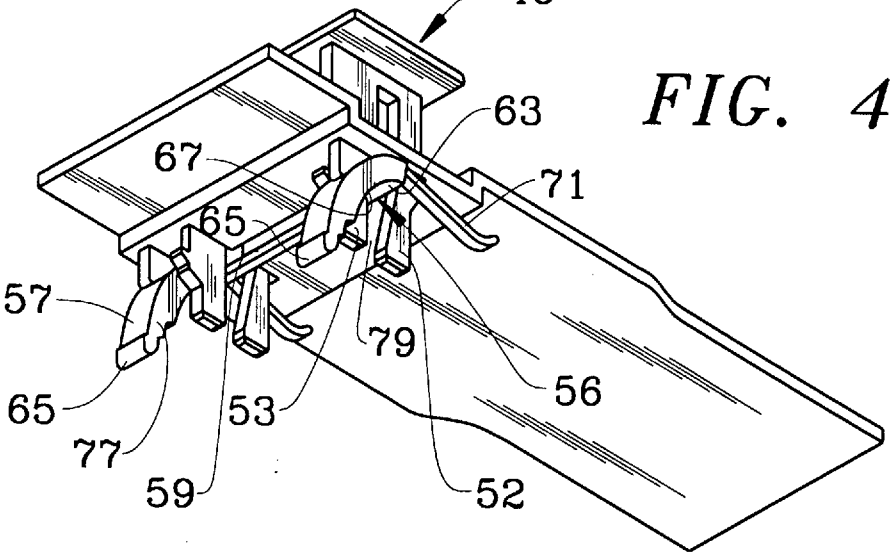
FIG. 4*a* is an isometric view of a top wall of the connector with the latch locking device and the catch in the unlocked position.
Figure 4B:
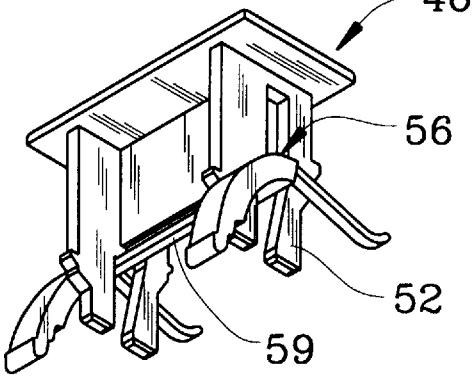
FIG. 4*b* is a view similar to that of FIG. 4*a* but without the top wall.

Referring to FIGS. 2 and 4, the connector 2 further comprises a locking device 44 comprising an actuation member 46 (see FIGS. 1 and 2) in the form of a push button 48 having side finger grips 50, the actuation member 46 being attached to locking extensions 52,53. In the unlocked position, the locking extensions 52,53 are not engaged in the gap 32 as shown in FIG. 6*c*.

Figures 6A, 6B, 6C, 7A, 7B, 7C:
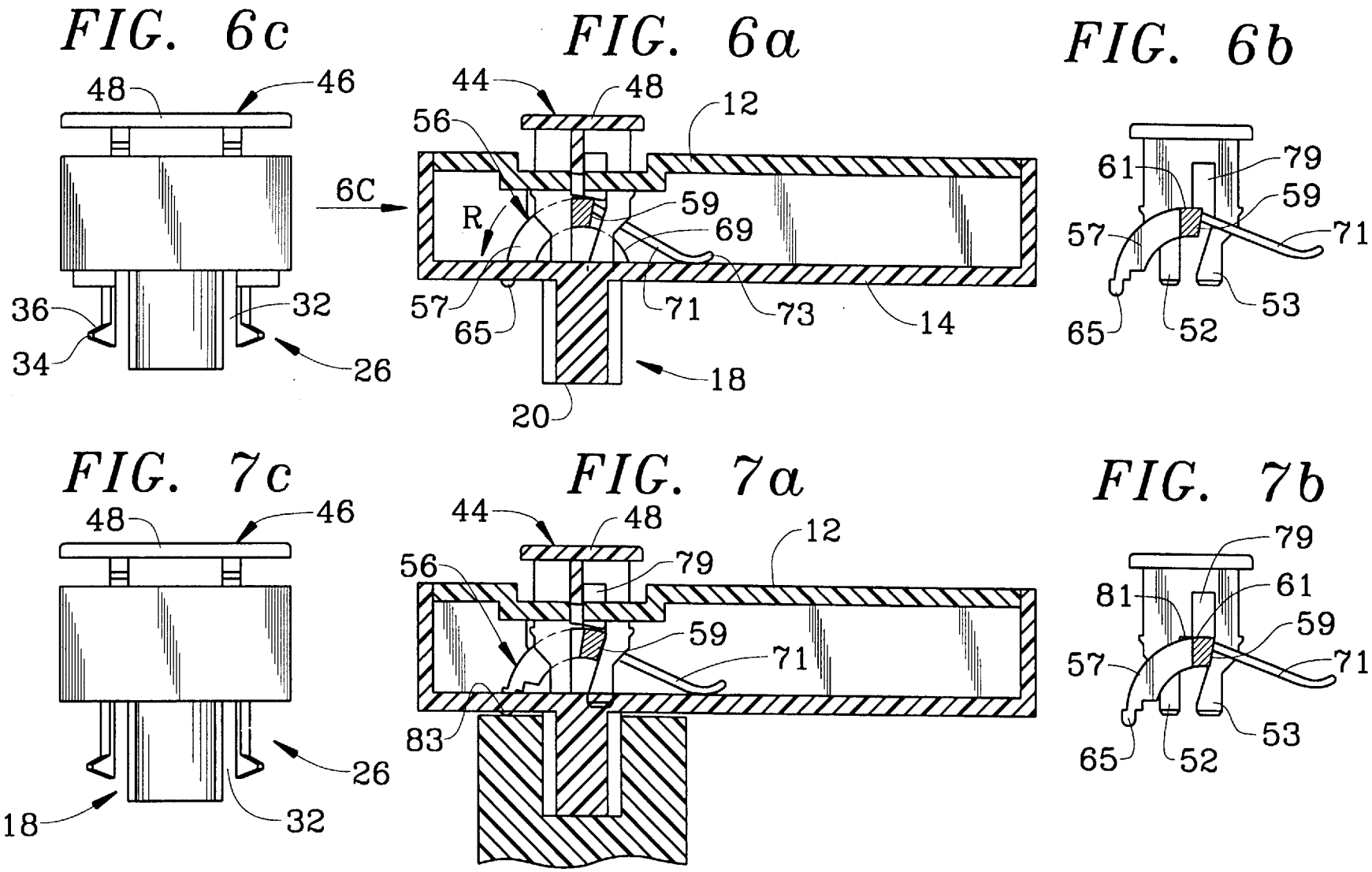
FIG. 6*a* is a cross-sectional view showing some of the connector whereby the locking device is in the unlocked position, held there by the catch.
FIG. 6*b* is a simplified view similar to that of FIG. 6*a*, without the housing of the connector.
FIG. 6*c* is an end view of the connector (view in the direction arrow 6*c* of FIG. 6*a*)
FIGS. 7*a* to 7*c* are similar to FIGS. 6*a* to 6*c* respectively, but showing the catch cammed to the release position.

The connector 2 further comprises a catch 56 that comprises a pair of pivotly mounted camming bars 57 held together by a retention bar 59 (also see FIG. 6*a*) that has an oblique retention shoulder 61 (see FIG. 6*b*). The camming bars 57 extend arcuately from an attachment end 63 at the retention bar 59, to a camming protrusion 65. A lower surface 67 of the camming bars 57 rests on an arcuate (semi-circular) surface or hump 69 (see FIGS. 3 and 6*a*) within the connector housing to enable rotational sliding movement of the catch thereon. The top wall 12 of the housing retains the catch in sliding movement against the semi-circular hump of 69. The catch further comprises cantilever beam spring members 71 extending from the retention bar in an opposed direction to the camming bars 57. When the catch is mounted on the hump 69 in the housing, as best seen in FIG. 6*a*, the spring members 71 are resiliently biased, proximate their free end 73, against the bottom wall 14 of the housing. As best seen in FIG. 1, the housing bottom wall 14 is provided with cut-outs 75 that allow the camming protrusion 65 to project therethrough.

Figure 5A:
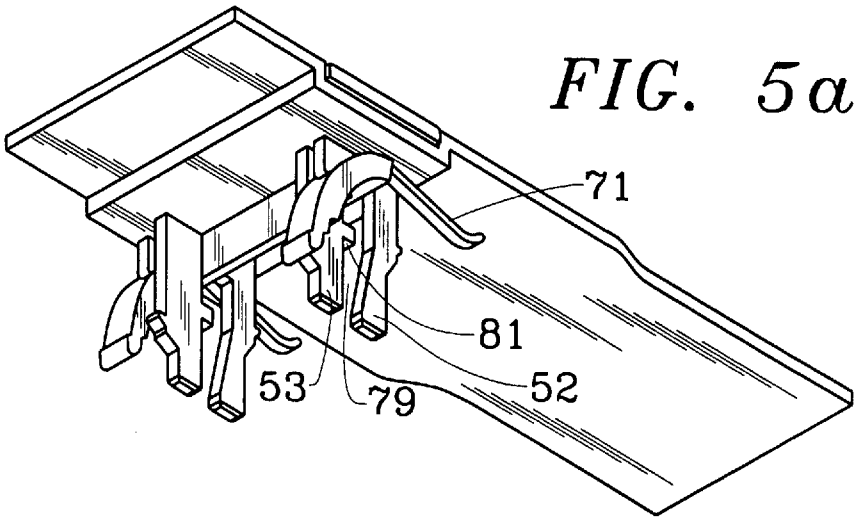
FIGS. 5*a* and 5*b* are similar to FIGS. 4*a* and 4*b* respectively, but showing the locking device and catch in the fully locked position.
Figure 5B:
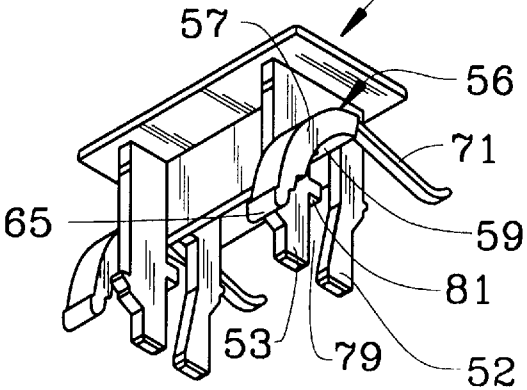

Referring to FIG. 4*a*, the locking extensions 52,53 are positioned proximate an inner side 77 of the locking bars 57, whereby the retention bar 59 is positioned in a slot 79 between the locking extensions 52 and 53. Referring to FIGS. 5*a* and 5*b*, one of the locking extensions 53 is provided with a retention shoulder 81 projecting therefrom that engages with the retention shoulder 61 of the retention bar 59 in the unlocked position as shown in FIG. 6*a* and 6*b*. Due to the resilient biasing of the cantilever spring 71, the catch 56 is pivotly biased in the latch retention position as shown in FIG. 6*a* and depicted by the arrow R, whereby the camming protrusions 65 project through the cut-outs 75 beyond the connector bottom wall 14. When the locking device is in the unlocked position, the push button 48 projects well above the top wall 12 in a clearly visible manner.

Figures 8A, 8B, 8C:
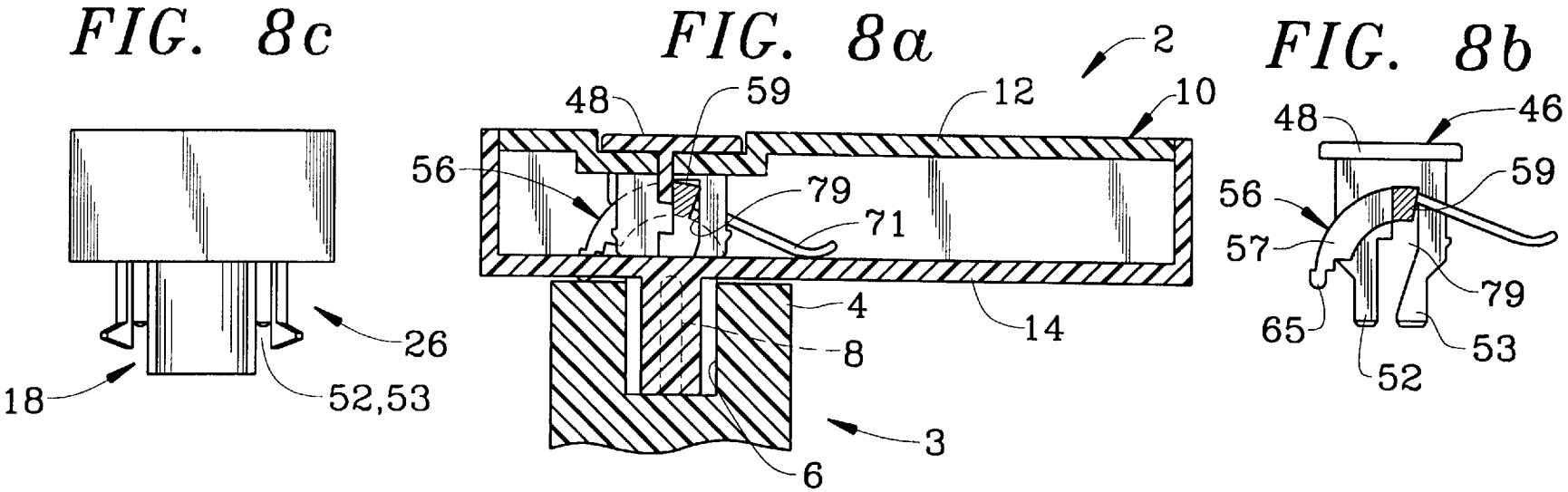
FIGS. 8*a* to 8*c* are similar to FIGS. 6*a* to 6*c* respectively, but showing the latch locking device in the fully locked position.

The push button 48 is positioned above (in the mating direction of the connectors) the contact receiving section 18. An operator coupling the connectors 2 and 3, would therefore grasp the connector, first inserting the contact receiving section 18 into the complementary connector cavity 6, applying pressure on the push button 48. The catch 56 however prevents insertion of the actuation member 46 into the fully locked position. The connector latches 26 are thus allowed to bias inwardly until the connectors 2 and 3 are fully mated and the latches click into their locking position. At that moment, as shown in FIGS. 7*a*–7*c*, the camming protrusion 65 of the catch abuts a complementary mating face 83 of the complementary connector 3 thus causing the catch to pivot in opposition to the spring force of the spring arms 71. The pivoting movement of the catch releases the retention shoulder 61 from the locking device retention shoulder 81. Continued depression on the locking device fully inserts the locking extensions 52,53 behind the latches 26 as shown in FIG. 8*c*, whereby the catch retention bar 59 passes through the slot 79 between the extension bars 52 and 53.

In the fully locked position, the resilient latches 26 are prevented from inward biasing by the locking extensions 52,53, thereby securely locking the connectors 2,3 together. In the fully locked position, the push button 48 is advantageously flush with the top wall 12 to prevent damage or catching onto external objects, as well as providing a clear visible indication of complete latching and locking.

Release of the connectors can be simply effected by pulling up on the finger grips 50, whereby in the fully unlocked position, the catch pivots to its retention position as shown in FIG. 6*a* by virtue of the spring action of the spring arm 71.

Advantageously therefore, an operator can mate the connectors in a single movement in the mating direction until the actuation member is fully depressed. Precocious engagement of the locking device is prevented whilst nevertheless enabling rapid and simple coupling of the connectors.

I claim:

1. An electrical connector for mating in a mating direction to a complementary connector having a cavity and terminals therein, said connector comprising an insulative housing and electrical terminals, the housing having a top wall, a bottom wall, and side and end walls respectively extending therebetween, the housing further comprising a contact receiving section extending from the bottom wall in the mating direction to a mating end, the connector further comprising at least one biasable latch for latching the connectors together and a locking device comprising an actuation member having at least one locking extension insertable from an unlocked position, to a locked position alongside the latch for locking the latch when the connector is coupled to the complementary connector, said locking device further comprising a deflectable catch mounted in the housing, comprising a retention shoulder engageable against a second retention shoulder located on the actuation member when the connectors are uncoupled to maintain the actuation member in the unlocked position, the catch further comprising a calming member engageable with the complementary connector upon full mating, the camming member linked to the retention shoulder whereby engagement and disengagement of the retention shoulder and the second retention shoulder is effected by movement of the catch and whereby the retention shoulder disengages from the second retention shoulder during camming engagement of the catch with the complementary connector, thereby releasing the actuation member for insertion thereof into the locked position.

2. The connector of claim 1 wherein the contact receiving section extends below the bottom wall of the housing, and the latches extend alongside the contact receiving section.

3. The connector of claim 2 wherein the latch is in the shape of a cantilever beam, attached at one end to the housing proximate the bottom wall and extending to a free end positioned towards the mating end.

4. The connector of claim 1 wherein the locking device comprises a push button extending above the top wall in the unlocked position and attached to the at least one locking extension for depressing said locking extension into the locked position.

5. The connector of claim 4 wherein the push button is substantially flush with, or below, the top wall when depressed into the locked position.

6. The connector of claim 4 wherein the push button is situated substantially above the contact receiving section, with respect to the mating direction.

7. The connector of claim 1 wherein the catch has a spring member for biasing the catch into engagement with the actuation member when the catch is in the unlocked position.

8. The connector of claim 1 wherein the catch is pivotally mounted in the housing, whereby engagement and disengagement of the retention shoulders of the catch and actuation members respectively is effected by rotation movement of the catch.

9. The connector of claim 8 wherein the catch is pivotally mounted by resting slideably on an arcuate hump of the housing.

10. The connector of claim 1 wherein the catch comprises a retention bar which includes the retention shoulder, the retention bar extending transversely to the mating direction and attached to the camming member, the camming member comprising a camming bar extending from the retention bar to a camming protrusion engageable with the complementary connector to release the actuation member.

11. The connector of claim 10 wherein the camming protrusion projects through a cut-out in the bottom wall for abutment with the complementary connector upon full mating.

12. The connector of claim 11 wherein the camming bar is arcuate and rests slidingly on the arcuate hump within the housing.

13. The connector of claim 10 wherein a catch spring member extends from the retention bar in an opposed direction to the camming bar.

14. The connector of claim 1 wherein the at least one locking extension comprises a slot extending in the mating direction for receiving a retention bar of the catch, and wherein the retention shoulder of the actuation member projects into the slot.

* * * * *